United States Patent [19]

Mele et al.

[11] Patent Number: 5,039,977

[45] Date of Patent: Aug. 13, 1991

[54] MULTIFUNCTIONAL BASKETBALL GAME MONITORING UNIT

[76] Inventors: Thomas C. Mele; Mary K. Mele, both of 4804 Palisade Dr.; Robert C. Dyer; Margaret A. Dyer, both of 4806 Palisade Dr., all of Austin, Tex. 78731

[21] Appl. No.: 435,038

[22] Filed: Nov. 13, 1989

Related U.S. Application Data

[63] Continuation-in-part of Ser. No. 293,703, Jan. 5, 1989.

[51] Int. Cl.[5] ..... G08B 23/00

[52] U.S. Cl. ..... 340/323 R; 273/1.5 R; 273/371; 364/410; 364/411; 434/248

[58] Field of Search ..... 340/323 R; 273/1.5 R, 273/371; 364/410, 411; 434/248

[56] References Cited

U.S. PATENT DOCUMENTS 3,868,671 2/1975 Maguire ..... 273/1.5 R
4,062,008 12/1977 Carlsson ..... 340/323 R
4,304,404 12/1981 Pundt ..... 434/248
4,858,920 8/1989 Best ..... 273/371

FOREIGN PATENT DOCUMENTS 1021369 12/1977 Canada ..... 273/1.5 R

*Primary Examiner*—Joseph A. Orsino
*Assistant Examiner*—Kinfe-Michael Negash
*Attorney, Agent, or Firm*—Joseph F. Long

[57] ABSTRACT

A multifunctional basketball game monitoring unit capable of sensing shots attempted and shots made in normal play and shots attempted and shots made from a spot location and further adjusting the score for the time a player remains in the air when shooting from the spot location; the unit acting to calculate, store, and display total time in play, total score, total percent of baskets made of total baskets attempted and total score shooting from the spot location for each of two backboard hoop assemblies.

6 Claims, 2 Drawing Sheets

MULTIFUNCTIONAL BASKETBALL GAME MONITORING UNIT

This a continuation-in-part of my patent serial number 07/293,703, filed 01/05/89, entitled A Multifunctional Basketball Game Monitoring Unit.

Background of the Invention

This invention is particularly suited to monitoring a basketball game wherein the game primarily consists of shooting baskets in a fixed time and is useful as both a game monitor and training tool. Further development work has led to expanding the monitoring to include special scoring when a player attempts a basket from a particular location sensed by a pressure sensitive pad. Although there are a variety of scorekeeping, sound effect systems, we do not find any wherein near misses and shots from a pressure sensitive pad to allow adjusting a score for jump time of a player are used.

SUMMARY OF THE INVENTION

The invention monitors shots made, shots attempted and shots made and attempted from a particular location with a pressure sensitive pad from this particular location communicating with electronic circuitry of the monitoring unit either by cable or by wireless communication. The electronic circuitry of the monitoring unit includes a central processing unit and a timing circuit and circuitry to allow each of two players to choose a period of play. The unit will monitor three different sensors on each one of two playing assemblies wherein a playing assembly comprises a backboard, a hoop, a pressure sensitive pad on a floor in front of the hoop and a sensor to determine when the basketball goes through the hoop and an impact sensor to determine when the basketball strikes the backboard or the hoop but does not go through the hoop.

The electronic circuitry allows a visual display on the monitoring unit of baskets made, percent baskets made of basket attempted and time of the player in the air for each shot attempted from the pressure sensitive pad and score made from the pressure sensitive pad location. Different audible tones are generated in the monitoring unit for baskets made, highest percentage of baskets made of baskets attempted, etc.

Electronic circuitry in the monitoring unit is adaptable to have plug-in ports to allow remote visual display and remote audio generation. Still other plug-in ports allow keyboard command and data input to the central processing unit and printer output of stored and calculated data.

DESCRIPTION OF PREFERRED EMBODIMENTS

Figure 1:
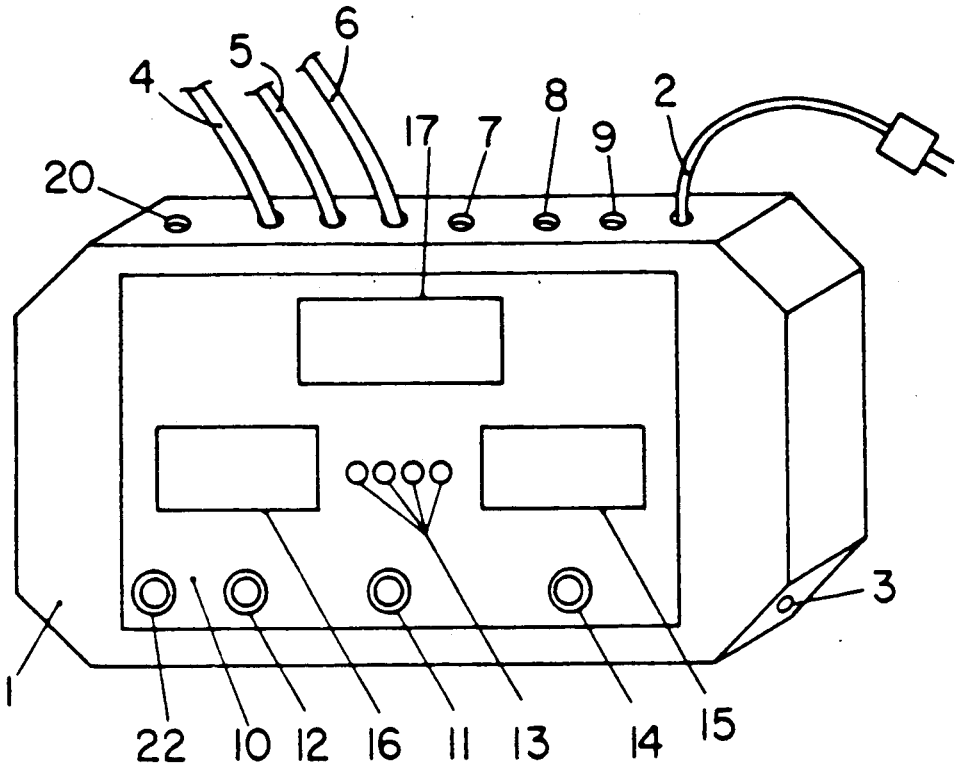
FIG. 1 is a perspective view of the housing of the monitoring unit indicating inputs, outputs, choice switches, internal scoreboard and timer displays.
Figure 2:
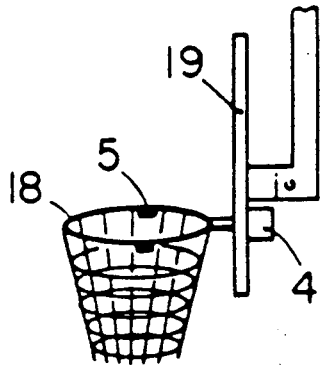
FIG. 2 shows impact sensor, infra-red sensor and pressure sensitive pad location.
Figure 2:
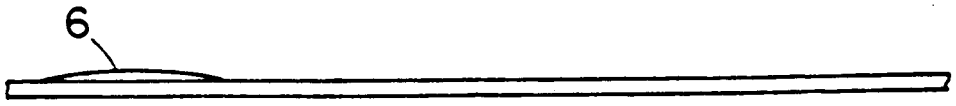

We will use the drawings and drawing numbers for the description of the invention and each number may be described as follows:

FIG. 1

1. One type of housing for the unit
2. Power Input. This is shown as 110V, but could also be battery input.
3. Power On-Off Switch
4. Input from an Impact Sensor. Note that a proximity
5. Input from an I-R Sensor. This sensor determines when a ball passes through the hoop. Other sensors such as photoelectric cell, laser beams, whisker operated switch, etc., would also be feasible.
6. Input from a Pressure Sensitive Pad. This indicates when a man puts weight on the pad and as he jumps in the air a timer in the central processing unit is started and measures time until the ball strikes the backboard or until a shot is made.
7. Input from a Keyboard.
8. Video Processor Output. This allows use of a normal TV set as an auxiliary to the unit.
9. Printer output
10. Internal Scoreboard and Controls
11. Start Switch
12. Time Mode Select Switch. This switch selects between timed play and free shooting.
13. Play Period Lights. These indicate periods of play
14. Player 1 or Player 2 Choice Switch
15. Player 2 Score
16. Player 1 Score
17. Timer Display
20. Plug-input for cables from an impact sensor, an infra-red detection and pressure sensitive pad from a second basket-backboard playing unit.
22. Three Position Mode Switch

FIG. 2

4. Impact Sensor
5. Infra-red Detector
6. Pressure Sensitive Pad
18. Hoop
19. Backboard

FIG. 3

4. Impact sensor
5. Infra-red Detector
6. Pressure Sensitive Pad
9. Printer
15. Score Display Player 2
16. Score Display Player 1
17. Timer Display
21. Central Processing Unit
25. Infra-red Sensor from 2nd Backboard
26. A Second Pressure Sensitive Pad for 2nd Backboard Play This invention is designed primarily for training in shooting baskets or for a two man game which is primarily shooting baskets. With the central processing unit as normally programmed the game with action of the monitoring unit may be as follows.

Referring to FIG. 1, a player first throws power on-off switch 3 to ON; he then selects either single player or double player option using player choice switch 14. The game sequence is started with switch 11 and if a certain time period is chosen he switches the time mode select switch 12 to ON. Now if a player wishes he may also set three position mode switch 22 to ON in 1 point mode and then when the player steps on the pressure sensitive pad 6, he receives a one point score for each basket made. The player may also set three position mode switch 22 to an ON, 3 point mode. In this case the player steps on pressure sensitive pad 6 and jumps in the air to throw the ball. If he throws the ball through the hoop, he then receives a three point score. The unit acts to reset scoring to two points per basket after an arbitrary time period. With settings as indicated display 16 will display accumulative score and display 15 will show shooting percentage when switch 14 is set to single player and switch 12 is in the time mode ON. When switch 14 is set to two players and time mode switch 12 is ON, display 16 will display player 1's accumulative score and display 15 will display player 2's accumulative score. When switch 14 is set to two players and switch 12 is in time mode OFF and using one basket, no distinction between players is mode and display 16 displays accumulative score and display 15 displays shooting percentage. When time period switch 12 is ON position, a player receives three points for each basket made in the last ten seconds of his time period and two points for each basket made previously. When time period switch 12 is in OFF position, each basket made counts two points.

Display 17 will display time remaining is a period when time select switch 12 is in the ON position and displays date and time when time select switch 12 is in the OFF position.

The four period lights 13 indicate periods or quarters when time select switch 12 is in the time mode ON.

To function as described the housing 1 has incoming line 5 from the infra-red sensor, incoming line 4 from the impact sensor and incoming line 6 from the pressure sensitive pad. In some embodiments the impact sensor 4 may not be used and the unit then functions as previously described, except does not display percent baskets made of baskets attempted.

In some embodiments there is an inlet plug 7 for keyboard input; plug 8 for video processor output and plug 9 for output to a printer.

The preferred embodiment has a plug in port 20, FIG. 1, to allow plugging in a bundled cable with an impact sensor lead, an infra-red detector lead and a pressure sensitive pad lead coming from a second hoop - backboard playing set up so that two players may play simultaneously. In this case the monitoring unit program displays accumulative score and percentage of baskets made of total attempted for one player on display 16 and for the other player on display 15.

Figure 3:
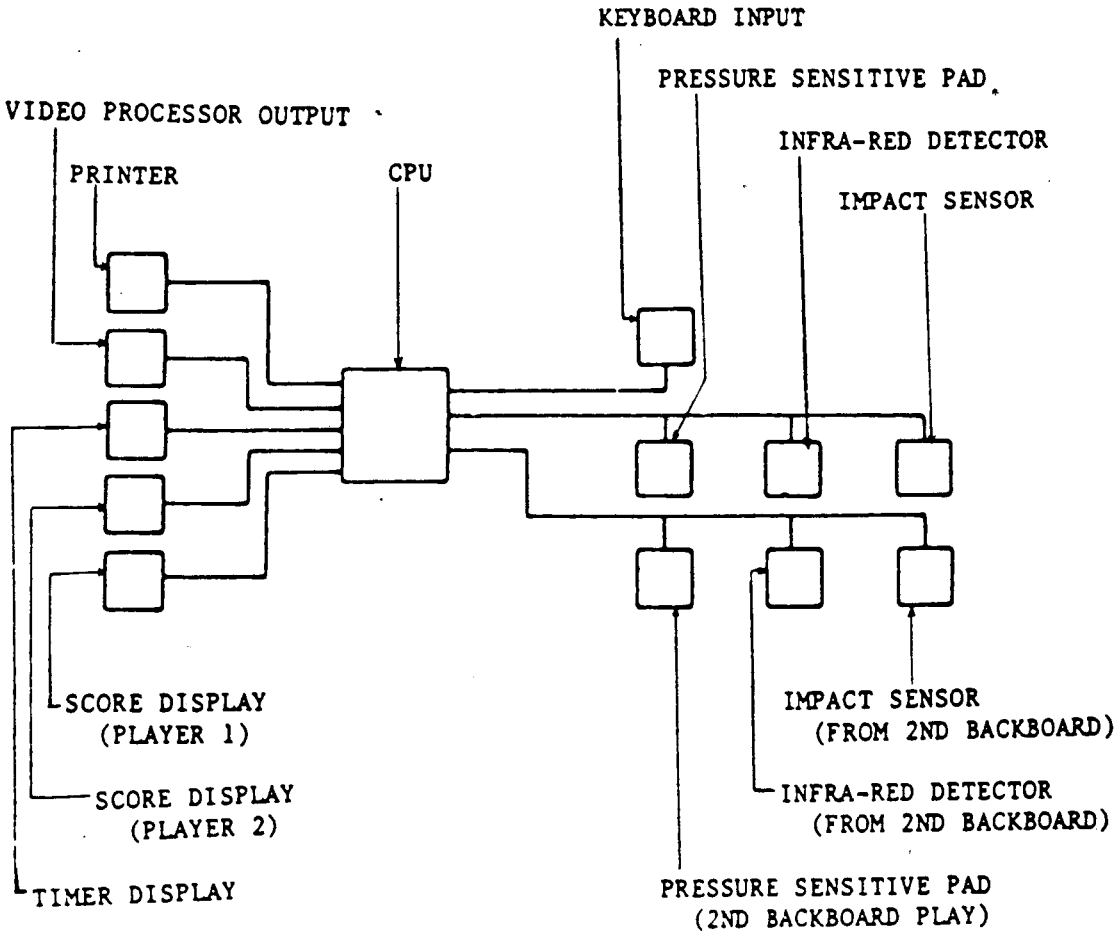
FIG. 3 indicates circuitry of the invention in block form.

The electronic circuitry for the unit is shown in block flowsheet form in FIG. 3. As shown, the microprocessor 21 communicates with keyboard 7 and with 1st backboard sensing devices 4, 5, 6 which are an impact sensor, an infra-red detector and a pressure sensitive pad and a similar second group of sensing devices 24, 25 and 26 associated with a second backboard playing unit may also be plugged into the microprocessor 21. Configuration or programming of the microprocessor 21 allows functioning as described with output to score displays 15 and 16, to timer display 17, to a printer 9, and to video processor 8.

Many minor changes can be visualized by one of normal skill in the electronic art and we therefore do not wish to be limited to exact details but only as to spirit and purpose as outlined in these claims and specifications.

We claim:

1. A multifunctional basketball game monitoring unit comprising:

(a) a housing;

(b) electronic circuitry means in said housing communicating with a first sensor means to sense a spot location of a player and with a second sensor means to determine when a basketball passes through a hoop; said electronic circuitry means acting to calculate, store, and display total score of baskets made and total score of basket made shooting from said spot location of a player.

2. A multifunctional basketball game monitoring unit as in claim 1 wherein said electronic means communicates with two of said first sensor means for a spot location of a player and with two of said second sensor means to determine when a basketball passes through the hoop; said electronic circuitry means acting to calculate, store, and display said total score of baskets made and said total score of baskets made shooting from said spot location of a player for each of two of said players.

3. A multifunctional basketball game monitoring unit as in claim 1 where said electronic circuitry means includes a timing means communicating with said first sensor means that may be activated by said player and that determines length of time and player remains in the air while attempting a shot through said hoop with said electronic circuitry adding predetermined points varying with the length of time and player stays in the air while attempting said shot.

4. A multifunctional basketball game monitoring unit as in claim 1 wherein a sensor means that functions to determine when a shot is attempted but not made also connects to said electronic circuitry means and wherein said electronic circuitry means acts to calculate, store, and display total score of baskets made and percent of baskets made of total baskets attempted.

5. A multifunctional basketball game monitoring unit as in claim 4 where said electronic circuitry means is adaptable to be connected with a printer and a TV set and keyboard input to enter commands and data to a central processing unit of said electronic circuitry means.

6. A multifunctional basketball game monitoring unit as in claim 5 wherein said electronic circuitry means generates different audible tones for baskets made and highest percentage score achieved in a play period and through a video processor outputs to said TV said different audible tones and said total score of baskets made and said percent of said baskets made of total baskets attempted.

* * * * *